US010434535B2

(12) United States Patent
Sugai et al.

(10) Patent No.: US 10,434,535 B2
(45) Date of Patent: Oct. 8, 2019

(54) FLUID EJECTION DEVICE

(71) Applicant: Seiko Epson Corporation, Tokyo (JP)

(72) Inventors: Keigo Sugai, Chino (JP); Eiji Okamoto, Matsumoto (JP); Shinichi Nakamura, Okaya (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 15/443,198

(22) Filed: Feb. 27, 2017

(65) Prior Publication Data

US 2017/0252769 A1 Sep. 7, 2017

(30) Foreign Application Priority Data

Mar. 3, 2016 (JP) ..... 2016-040813

(51) Int. Cl.
*B05B 17/06* (2006.01)
*B41J 2/04* (2006.01)

(52) U.S. Cl.
CPC ..... *B05B 17/0669* (2013.01); *B05B 17/0676* (2013.01); *B41J 2/04* (2013.01)

(58) Field of Classification Search
CPC ..... B05B 17/0669; B05B 17/0676; B41J 2/04
USPC ..... 239/102.2
See application file for complete search history.

(56) References Cited

U.S. PATENT DOCUMENTS 4,362,407 A 12/1982 Kolm et al.
5,893,350 A 4/1999 Timms
6,191,522 B1 2/2001 Reuter
6,749,126 B1 * 6/2004 Ruehle ..... F02M 51/0603 239/102.1
7,309,027 B2 * 12/2007 Magel ..... F02M 51/0603 239/102.2
9,156,054 B2 10/2015 Ikushima
(Continued)

FOREIGN PATENT DOCUMENTS

DE 10-2011-108799 A1 1/2013
EP 1121249 B1 7/2007
(Continued)

OTHER PUBLICATIONS

Extended European Search Report for Application No. EP 17 15 9251 dated Oct. 12, 2017 (6 pages).
(Continued)

*Primary Examiner* — Christopher S Kim
(74) *Attorney, Agent, or Firm* — Harness, Dickey & Pierce, P.L.C.

(57) ABSTRACT

A fluid ejection device is a fluid ejection device adapted to eject a fluent material, including a fluent material chamber supplied with the fluent material, a moving object, which can reciprocate in the fluent material chamber, a nozzle part having a discharge port communicating with the fluent material chamber, and an inner wall on a periphery of the discharge port on which a tip part of the moving object can contact from the fluent material chamber side, and an actuator having contact with a back end part of the moving object to reciprocate the moving object to thereby discharge the fluent material from the discharge port. The actuator has a plurality of solid-state displacement elements connected in series to each other, and one end of one of the plurality of solid-state displacement elements has contact with the back end part of the moving object.

7 Claims, 4 Drawing Sheets

(56) References Cited

U.S. PATENT DOCUMENTS

| | | | | |
|---|---|---|---|---|
| 9,339,839 | B2 | 5/2016 | Fliess et al. | |
| 10,144,031 | B2 * | 12/2018 | Sugai | B05B 17/0669 |
| 2002/0180844 | A1 | 12/2002 | Takahagi et al. | |
| 2006/0256164 | A1 | 11/2006 | Hirota et al. | |
| 2009/0167818 | A1 * | 7/2009 | Morita | B41J 2/04581 347/47 |
| 2014/0291358 | A1 | 10/2014 | Fliess et al. | |
| 2017/0252770 | A1 | 9/2017 | Sugai | |

FOREIGN PATENT DOCUMENTS

| | | | |
|---|---|---|---|
| JP | 04-365384 | A | 12/1992 |
| JP | 10-103183 | A | 4/1998 |
| JP | 2001-503920 | A | 3/2001 |
| JP | 2009-184358 | A | 8/2009 |
| JP | 2014-525831 | A | 10/2014 |
| WO | WO-2008-146464 | A1 | 12/2008 |

OTHER PUBLICATIONS

Extended European Search Report for Application No. EP 17 15 9266 dated Sep. 6, 2017 (6 pages).

* cited by examiner

FLUID EJECTION DEVICE

BACKGROUND

1. Technical Field

The present invention relates to a fluid ejection device.

2. Related Art

There has been known a fluid ejection device adapted to discharge to fly a droplet material using reciprocation of a moving object. In many cases, an actuator using a piezoelectric element or the like is used as a drive source for translating the moving object. Since the piezoelectric element can generate only a small amount of displacement, the amount of displacement is amplified via an amplification mechanism in the technology described in, for example, JP-T-2014-525831 (the term "JP-T" as used herein means a published Japanese translation of a PCT patent application).

However, if the amplification mechanism is used, the configuration becomes complicated, and there is a possibility of incurring growth in size of the drive device. Therefore, there has been desired a technology capable of providing a sufficient amount of displacement of a moving object without using the amplification mechanism in a fluid ejection device for discharging a droplet using reciprocation of the moving object.

SUMMARY

An advantage of some aspects of the invention is to solve at least a part of the problems described above, and the invention can be implemented as the following aspects.

(1) According to an aspect of the invention, a fluid ejection device is provided. The fluid ejection device is a fluid ejection device adapted to eject a fluent material, the fluid ejection device including a fluent material chamber supplied with the fluent material, a moving object capable of reciprocating in the fluent material chamber, a nozzle part having a discharge port communicating with the fluent material chamber, and an inner wall on a periphery of the discharge port on which a tip part of the moving object can contact from the fluent material chamber side, and an actuator having contact with a back end part of the moving object to reciprocate the moving object to thereby discharge the fluent material from the discharge port, wherein the actuator has a plurality of solid-state displacement elements connected in series to each other, and one end of one of the plurality of solid-state displacement elements has contact with the back end part of the moving object. According to the fluid ejection device having such a configuration, since the actuator for reciprocating the moving object is formed of a plurality of solid-state displacement elements connected in series to each other, the sufficient displacement amount of the moving object can be obtained without using an amplification mechanism.

(2) The fluid ejection device according to the aspect of the invention may further include a fluent material reservoir in which the fluent material is reserved, a flow channel, which communicates with the fluent material reservoir and the fluent material chamber, and through which the fluent material flows, and a pressurizing section adapted to pressurize the fluent material reserved in the fluent material reservoir to supply the flow channel with the fluent material. According to such a configuration, since the fluent material is pressurized to be supplied from the fluent material reservoir to the fluent material chamber, it is possible to discharge the material high in viscosity.

(3) In the fluid ejection device according to the aspect of the invention, a drive signal supply section that supplies a signal for driving the solid-state displacement element may individually be connected to each of the plurality of solid-state displacement elements. According to such a configuration, since the drive signals different from each other can be supplied respectively to the plurality of solid-state displacement elements, it is possible to increase the freedom of the expansion and contraction action of the actuator.

(4) In the fluid ejection device according to the aspect of the invention, the plurality of solid-state displacement elements may be different in resonance frequency, and the solid-state displacement element disposed on the back end side of the moving object may be the highest of the plurality of solid-state displacement elements in resonance frequency. According to such a configuration, since the sufficient speed of the moving object can be obtained, it is possible to discharge the material high in viscosity.

(5) In the fluid ejection device according to the aspect of the invention, the plurality of solid-state displacement elements may be different in expansion speed, and the solid-state displacement element disposed on the back end side of the moving object may be the highest of the plurality of solid-state displacement elements in expansion speed. According to such a configuration, since the sufficient speed of the moving object can be obtained, it is possible to discharge the material high in viscosity.

(6) In the fluid ejection device according to the aspect of the invention, the plurality of solid-state displacement elements may be different in maximum displacement amount, and the solid-state displacement element disposed on the back end side of the moving object may be the smallest of the plurality of solid-state displacement elements in maximum displacement amount. According to such a configuration, since the sufficient speed of the moving object can be obtained, it is possible to discharge the material high in viscosity.

(7) In the fluid ejection device according to the aspect of the invention, it is also possible that the plurality of solid-state displacement elements may be connected to each other via a contact part, and the contact part may have one of point contact and line contact with each of the solid-state displacement elements. According to such a configuration, since it is possible to prevent the mutual heat generation of the piezoelectric elements from affecting each other, the durability of the piezoelectric elements is improved.

(8) The fluid ejection device according to the aspect of the invention may further include a biasing member adapted to bias the moving object in a direction from the discharge port toward the actuator. According to such a configuration, since the preliminary load can be applied by the biasing member, the durability of the solid-state displacement elements is improved.

It should be noted that the invention can be implemented in a variety of forms such as a fluid ejection system, or a method of ejecting a fluid.

BRIEF DESCRIPTION OF THE DRAWINGS

The invention will be described with reference to the accompanying drawings, wherein like numbers reference like elements.

DESCRIPTION OF EXEMPLARY EMBODIMENTS

A. First Embodiment

Figure 1:
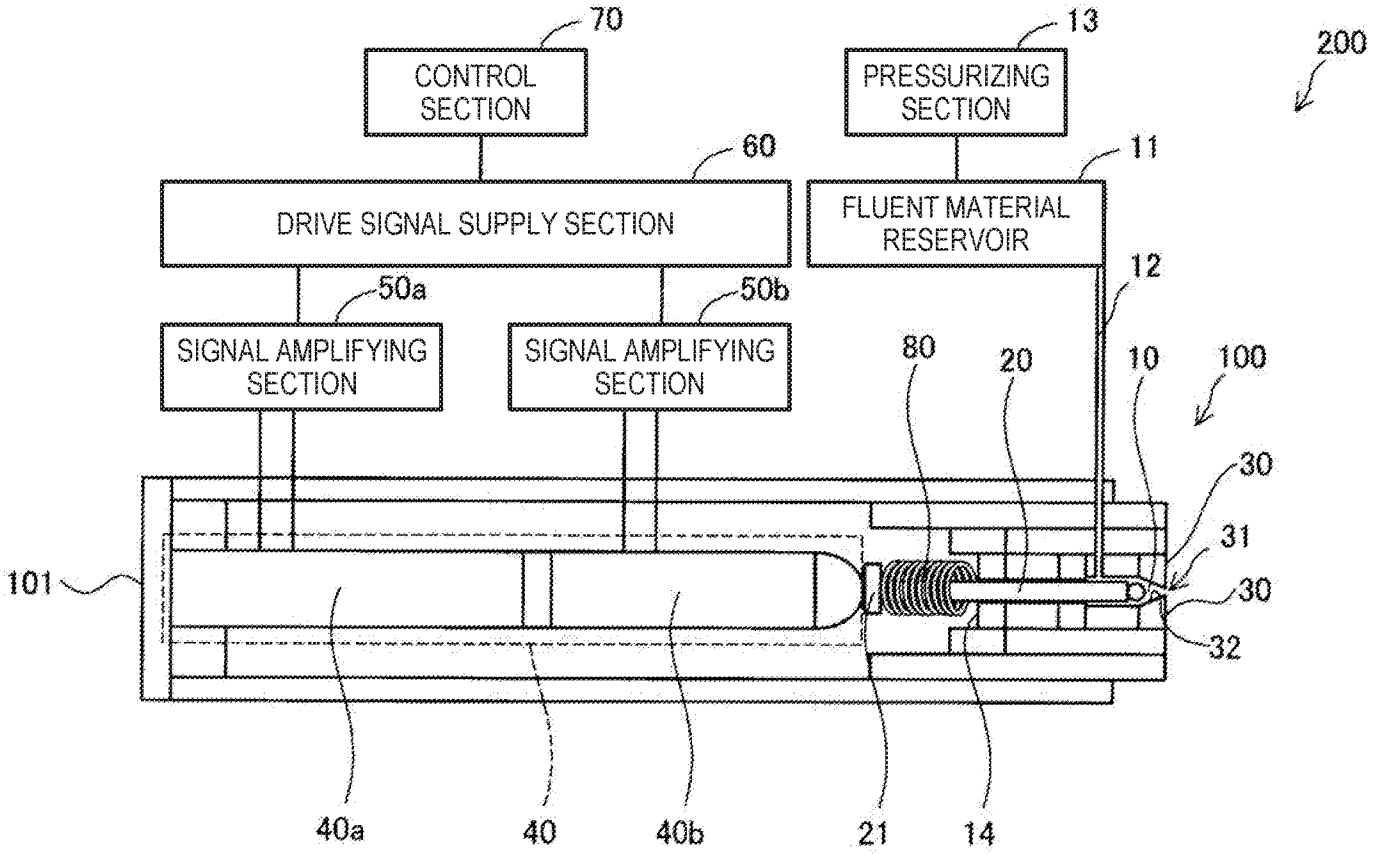
FIG. 1 is a schematic configuration diagram of a fluid ejection system according to a first embodiment of the invention.

FIG. 1 is a schematic configuration diagram of a fluid ejection system 200 including a fluid ejection device 100 according to a first embodiment of the invention. The fluid ejection device 100 is, for example, a device used for a printer, and a device for discharging a minute amount of a variety of fluent materials in a range from a fluent material low in viscosity such as water, a solvent, or a reagent to a fluent material high in viscosity such as a solder paste, a silver paste, or an adhesive at high speed irrespective of presence or absence of a filler.

The fluid ejection system 200 is provided with the fluid ejection device 100, a fluent material reservoir 11, a flow channel 12, a pressurizing section 13, a drive signal supply section 60, and a control section 70. The fluid ejection device 100 is provided with a fluent material chamber 10, a moving object 20, a nozzle part 30, an actuator 40, and a biasing member 80. It should be noted that the fluid ejection system 200 can also be figured out as a fluid ejection device in a broad sense.

In the fluent material chamber 10, there is reserved a fluent material. The fluent material chamber 10 is supplied with the fluent material from the fluent material reservoir 11 through the flow channel 12. The fluent material reserved in the fluent material reservoir 11 is pressurized by the pressurizing section 13, and is thus supplied to the flow channel 12. In the fluent material chamber 10, there is disposed a tip part of the moving object 20 capable of reciprocating in the fluent material chamber 10. Further, on one side surface of the fluent material chamber 10, there is disposed the nozzle part 30 at a position opposed to the tip side of the moving object 20.

The nozzle part 30 has a discharge port 31 communicating with the fluent material chamber 10. The tip part of the moving object 20 is capable of having contact with an inner wall 32 on the periphery of the discharge port 31 from the fluent material chamber 10 side. The inner wall 32 is tilted to form a tapered shape. Due to the collision of the moving object 20 to the part having the tapered shape, the fluent material in the fluent material chamber 10 is discharged from the nozzle part 30.

The moving object 20 is, for example, a rod-like member having a tip shaped like a plane or a sphere, or having a tip provided with a projection. The moving object 20 is provided with the biasing member 80 disposed in a back end part. The biasing member 80 biases the moving object 20 in a direction from the discharge port 31 toward the actuator 40. More specifically, the biasing member 80 is disposed so as to be sandwiched between a flange part 21, which is disposed on the back end part of the moving object 20, and a wall surface 14, which is located on the actuator 40 side of the fluent material chamber 10, and thus, the biasing member 80 biases the moving object 20 toward the actuator 40. Due to the biasing force by the biasing member 80, a preliminary load is applied to the actuator 40 (a solid-state displacement element 40*a*, a solid-state displacement element 40*b*). In the present embodiment, the biasing member 80 is formed of a compression coil spring. It should be noted that the biasing member 80 can also be formed of a different elastic member such as a rubber spring.

The actuator 40 is provided with the solid-state displacement elements 40*a*, 40*b* as a plurality of solid-state displacement elements connected in series to each other. One end of the solid-state displacement element 40*b* among the plurality of solid-state displacement elements 40*a*, 40*b* has contact with the back end part of the moving object 20. An end part of the other solid-state displacement element 40*a* located on an opposite side to the moving object 20 out of the plurality of solid-state displacement elements 40*a*, 40*b* is fixed to a housing 101 of the fluid ejection device 100. The actuator 40 reciprocates the moving object 20 to thereby discharge the fluent material from the discharge port 31.

In the present embodiment, the solid-state displacement element 40*a* and the solid-state displacement element 40*b* are each a piezoelectric element having a rod-like shape or a block-like shape expanding and contracting in the longitudinal direction. In the present embodiment, the solid-state displacement element 40*a* and the solid-state displacement element 40*b* are equal to each other in resonance frequency, expansion speed, and maximum displacement amount. The solid-state displacement element 40*a* and the solid-state displacement element 40*b* are bonded to each other with an adhesive. As the adhesive, there can be used, for example, epoxy resin or acrylic adhesive.

A signal amplifying section 50*a* is connected to the solid-state displacement element 40*a*, and a signal amplifying section 50*b* is connected to the solid-state displacement element 40*b*. The drive signal supply section 60 is connected to the signal amplifying sections 50*a*, 50*b* and the control section 70.

The drive signal supply section 60 generates drive signals for driving the actuator 40. The drive signals generated by the drive signal supply section 60 are amplified by the respective signal amplifying sections 50*a*, 50*b*, and are then applied to the respective solid-state displacement elements 40*a*, 40*b*. Generation of the drive signals by the drive signal supply section 60 is controlled by the control section 70. In the present embodiment, the same waveform is output from the drive signal supply section 60 to the signal amplifying section 50*a* and the signal amplifying 50*b*, and is applied to the solid-state displacement elements 40*a*, 40*b*.

According to the fluid ejection device 100 related to the present embodiment described hereinabove, since the actuator 40 for reciprocating the moving object is formed of a plurality of solid-state displacement elements 40*a*, 40*b* connected in series to each other, the sufficient displacement amount of the moving object 20 can be obtained without using an amplification mechanism. As a result, it is possible to miniaturize the fluid ejection device 100.

Further, in the present embodiment, since the fluent material is pressurized by the pressurizing section 13 to be supplied from the fluent material reservoir 11 to the fluent material chamber 10, it is possible to discharge the material high in viscosity.

Further, in the present embodiment, since the drive signal supply section 60 for generating the drive signals is used commonly in the solid-state displacement element 40*a* and the solid-state displacement element 40*b*, it is possible to simplify the device configuration.

Further, in the present embodiment, since the preliminary load is applied by the biasing member 80 to the solid-state displacement elements 40*a*, 40*b*, it is possible to prevent the tensile stress from acting on the solid-state displacement elements 40*a*, 40*b*. As a result, the durability of the solid-state displacement elements 40*a*, 40*b* is improved.

B. Second Embodiment

Figure 2:
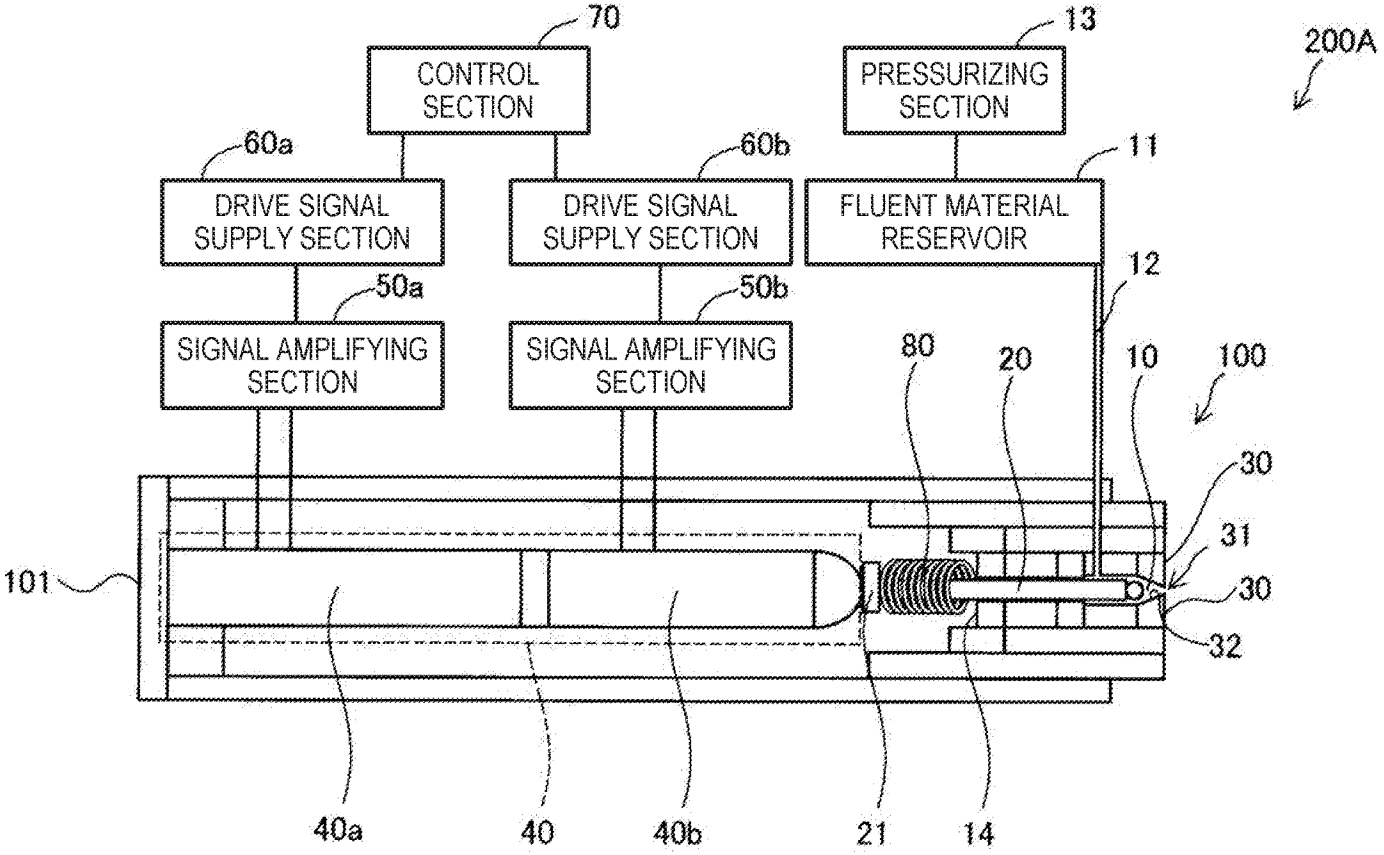
FIG. 2 is a schematic configuration diagram of a fluid ejection system according to a second embodiment of the invention.

FIG. 2 is a schematic configuration diagram of a fluid ejection system 200A according to a second embodiment of the invention. The configuration of the fluid ejection device 100 according to the present embodiment is the same as the configuration of the fluid ejection device 100 according to the first embodiment. The fluid ejection system 200A according to the present embodiment is different from the first embodiment in the point that the drive signal supply section 60*a* is connected to the signal amplifying section 50*a*, and the drive signal supply section 60*b* is connected to the signal amplifying section 50*b*. In other words, in the present embodiment, the drive signal supply sections 60*a*, 60*b* are individually connected to the signal amplifying sections 50*a*, 50*b*. The drive signals generated by the drive signal supply sections 60*a*, 60*b* are amplified by the signal amplifying sections 50*a*, 50*b* connected respectively thereto, and are then applied to the respective solid-state displacement elements 40*a*, 40*b*.

According to the fluid ejection device 100 related to the present embodiment described hereinabove, since it is possible to supply the drive signals different from each other respectively to the solid-state displacement element 40*a* and the solid-state displacement element 40*b*, the freedom of the expansion and contraction action of the actuator 40 can be enhanced.

C. Third Embodiment

Figure 3:
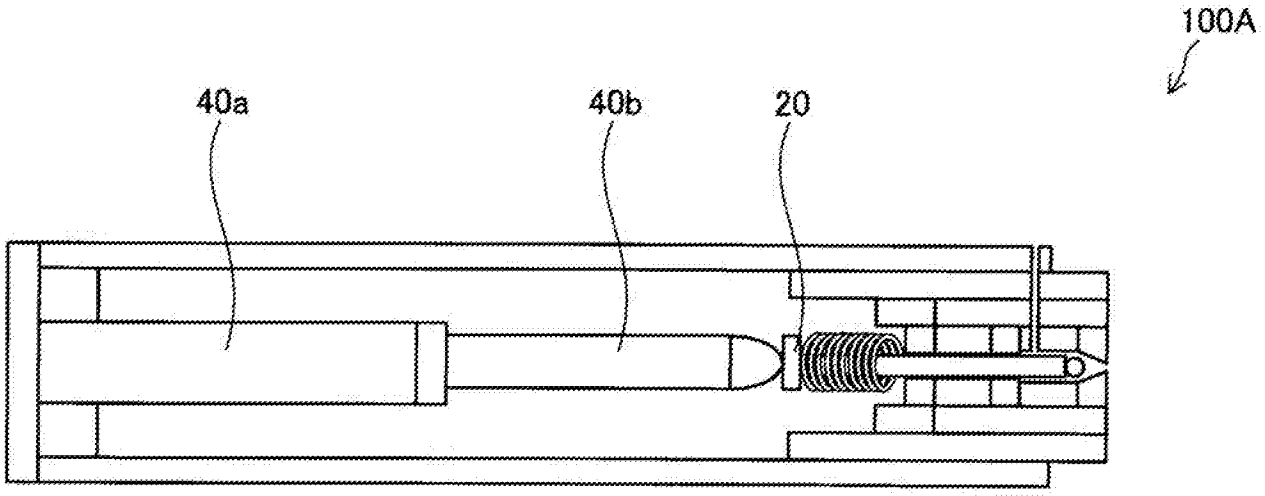
FIG. 3 is a schematic configuration diagram of a fluid ejection device according to a third embodiment of the invention.

FIG. 3 is a schematic configuration diagram of a fluid ejection device 100A according to a third embodiment of the invention. The fluid ejection device 100A according to the present embodiment is different from the first embodiment in the point that the solid-state displacement element 40*a* and the solid-state displacement element 40*b* are different in characteristics from each other, and is the same as the first embodiment in the rest of the configuration.

The fluid ejection device 100A according to the present embodiment is provided with the solid-state displacement elements 40*a*, 40*b* different in resonance frequency from each other. In the present embodiment, the resonance frequency of the solid-state displacement element 40*b* disposed on the back end side of the moving object 20 is higher than the resonance frequency of the solid-state displacement element 40*a*.

According to the fluid ejection device 100A related to the present embodiment described hereinabove, the solid-state displacement element 40*b* is higher in resonance frequency than the solid-state displacement element 40*a*, and can therefore move the moving object 20 toward the discharge port 31 at higher speed than the solid-state displacement element 40*a*. Therefore, since the sufficient speed of the moving object 20 can be obtained, it is possible to discharge the material high in viscosity.

D. Fourth Embodiment

Figure 4:
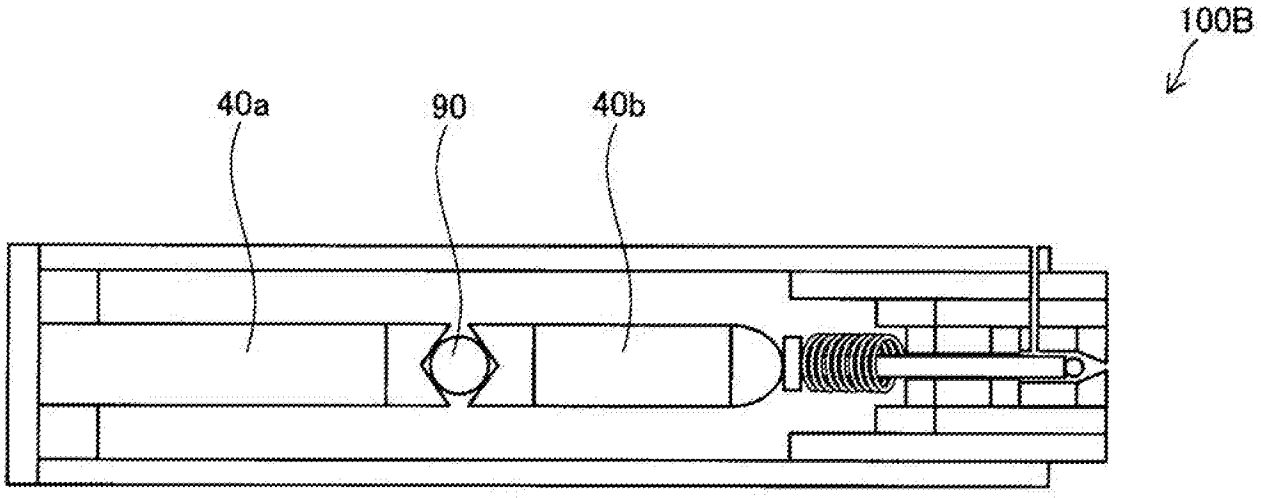
FIG. 4 is a schematic configuration diagram of a fluid ejection device according to a fourth embodiment of the invention.

FIG. 4 is a schematic configuration diagram of a fluid ejection device 100B according to a fourth embodiment of the invention. The fluid ejection device 100B according to the present embodiment is different from the first embodiment in the point that the solid-state displacement elements 40*a*, 40*b* are connected to each other via a contact part 90, and is the same as the first embodiment in the rest of the configuration.

The fluid ejection device 100B according to the present embodiment is provided with the contact part 90 shaped like a true sphere. The end surface of each of the solid-state displacement elements 40*a*, 40*b* having contact with the contact part 90 is recessed to form a tapered shape. Therefore, the contact part 90 and each of the solid-state displacement elements 40*a*, 40*b* have line contact with each other. The contact part 90 is a rigid body, and is formed of metal or ceramic.

According to the fluid ejection device 100B related to the present embodiment described hereinabove, since it is possible for the contact part 90 to prevent the mutual heat generation of the solid-state displacement elements 40*a*, 40*b* from affecting each other, the durability of the solid-state displacement elements 40*a*, 40*b* is improved.

E. Modified Examples

First Modified Example

In each of the embodiments described above, the piezoelectric element is used as the solid-state displacement element. In contrast, it is also possible to use a magnetostrictive element as the solid-state displacement element.

Second Modified Example

In the first embodiment described above, the moving object 20 and the solid-state displacement element 40*b* can also be bonded to each other with an adhesive without disposing the biasing member 80. According also to such a configuration, since the sufficient speed of the moving object 20 can be obtained, it is possible to discharge the material high in viscosity.

Third Modified Example

In the third embodiment described above, as the solid-state displacement element 40*b*, there can also be used a solid-state displacement element higher in expansion speed than the solid-state displacement element 40*a*. According also to such a configuration, since the sufficient speed of the moving object 20 can be obtained, it is possible to discharge the material high in viscosity.

Fourth Modified Example

In the third embodiment described above, as the solid-state displacement element 40*b*, there can also be used a solid-state displacement element smaller in maximum displacement amount than the solid-state displacement element 40*a*. According also to such a configuration, since the sufficient speed of the moving object 20 can be obtained, it is possible to discharge the material high in viscosity.

Fifth Modified Example

In the fourth embodiment, it is also possible to use a flat surface as the end surface of each of the solid-state displacement elements 40*a*, 40*b* having contact with the contact part 90 to thereby make the contact part 90 and each of the solid-state displacement elements 40*a*, 40*b* have point contact with each other. Further, it is also possible to make one have point contact with each other, and the other have line contact with each other.

The invention is not limited to the embodiments and the modified examples described above, but can be implemented with a variety of configurations within the scope or the spirit of the invention. For example, the technical features in the embodiments and the modified examples corresponding to the technical features in the aspects described in the SUMMARY section can arbitrarily be replaced or combined in order to solve the problems described above, or in order to achieve all or a part of the advantages described above. Further, the technical feature can arbitrarily be eliminated unless described in the specification as an essential element.

The entire disclosure of Japanese Patent Application No. 2016-040813, filed Mar. 3, 2016 is expressly incorporated by reference herein.

What is claimed is:

1. A fluid ejection device adapted to eject a fluent material comprising:

a fluent material reservoir in which the fluent material is held;

a fluent material chamber supplied with the fluent material, the fluent material chamber being housed in a case, an entirety of the fluent material chamber being provided next to an end of the case;

a flow channel that fluidly communicates with the fluent material reservoir and the fluent material chamber, the flow channel being configured to pass the fluent material from the fluent material reservoir to the fluent material chamber;

a reciprocating rod that is housed in the case, the rod being partially located inside the fluent material chamber, the rod being configured to reciprocate in the fluent material chamber;

a nozzle body having a discharge port and an inner space, the nozzle body being provided at the end of the case so that the discharge port is opened to an outside of the case, the inner space of the nozzle body fluidly communicating with the fluent material chamber, a tip of the rod being configured to selectively abut an inner wall of the discharge port in the inner space; and an actuator that is configured to contact a back end of the rod so as to reciprocate the rod and discharge the fluent material from the discharge port, wherein the actuator has a plurality of rod-shaped piezoelectric elements connected in series to each other in a longitudinal direction, and one end of one of the plurality of rod-shaped piezoelectric elements contacts the back end of the rod, wherein the fluent material chamber has a rod receiving opening opposite to the nozzle body, a distal end of the rod extends through the rod receiving opening, a junction between the fluent material chamber and one end of the flow channel is located between the rod receiving opening and the inner space of the nozzle body, wherein the plurality of rod-shaped piezoelectric elements have different resonance frequencies, and the one of the plurality of rod-shaped piezoelectric elements that contacts the back end of the rod has the highest resonance frequency of the plurality of rod-shaped piezoelectric elements.

2. The fluid ejection device according to claim 1, further comprising:

a pressurizing source that is configured to pressurize the fluent material held in the fluent material reservoir to supply the fluent material to the fluent material chamber via the flow channel.

3. The fluid ejection device according to claim 1, further comprising:

a drive signal generator that is configured to provide a drive signal for respectively driving each of the plurality of rod-shaped piezoelectric elements.

4. The fluid ejection device according to claim 1, wherein two adjacent ones of the plurality of rod-shaped piezoelectric elements are connected to each other via a contact member, and the contact member has one of point contact and line contact with each of the two adjacent rod-shaped piezoelectric elements.

5. The fluid ejection device according to claim 1, further comprising:

a biasing member that is configured to bias the rod away from the discharge port and toward the actuator, wherein the biasing member is located entirely outside of the fluent material chamber.

6. A fluid ejection device adapted to eject a fluent material comprising:

a fluent material reservoir in which the fluent material is held;

a fluent material chamber supplied with the fluent material, the fluent material chamber being housed in a case, an entirety of the fluent material chamber being provided next to an end of the case;

a flow channel that fluidly communicates with the fluent material reservoir and the fluent material chamber, the flow channel being configured to pass the fluent material from the fluent material reservoir to the fluent material chamber;

a reciprocating rod that is housed in the case, the rod being partially located inside the fluent material chamber, the rod being configured to reciprocate in the fluent material chamber;

a nozzle body having a discharge port and an inner space, the nozzle body being provided at the end of the case so that the discharge port is opened to an outside of the case, the inner space of the nozzle body fluidly communicating with the fluent material chamber, a tip of the rod being configured to selectively abut an inner wall of the discharge port in the inner space; and an actuator that is configured to contact a back end of the rod so as to reciprocate the rod and discharge the fluent material from the discharge port, wherein the actuator has a plurality of rod-shaped piezoelectric elements connected in series to each other in a longitudinal direction, and one end of one of the plurality of rod-shaped piezoelectric elements contacts the back end of the rod, wherein the fluent material chamber has a rod receiving opening opposite to the nozzle body, a distal end of the rod extends through the rod receiving opening, a junction between the fluent material chamber and one end of the flow channel is located between the rod receiving opening and the inner space of the nozzle body, wherein the plurality of rod-shaped piezoelectric elements have different expansion speeds, and the one of the plurality of rod-shaped piezoelectric elements that contacts the back end of the rod has the highest expansion speed of the plurality of rod-shaped piezoelectric elements.

7. A fluid ejection device adapted to eject a fluent material comprising:

a fluent material reservoir in which the fluent material is held;

a fluent material chamber supplied with the fluent material, the fluent material chamber being housed in a case, an entirety of the fluent material chamber being provided next to an end of the case;

a flow channel that fluidly communicates with the fluent material reservoir and the fluent material chamber, the flow channel being configured to pass the fluent material from the fluent material reservoir to the fluent material chamber;

a reciprocating rod that is housed in the case, the rod being partially located inside the fluent material chamber, the rod being configured to reciprocate in the fluent material chamber;

a nozzle body having a discharge port and an inner space, the nozzle body being provided at the end of the case so that the discharge port is opened to an outside of the case, the inner space of the nozzle body fluidly communicating with the fluent material chamber, a tip of the rod being configured to selectively abut an inner wall of the discharge port in the inner space; and an actuator that is configured to contact a back end of the rod so as to reciprocate the rod and discharge the fluent material from the discharge port, wherein the actuator has a plurality of rod-shaped piezoelectric elements connected in series to each other in a longitudinal direction, and one end of one of the plurality of rod-shaped piezoelectric elements contacts the back end of the rod, wherein the fluent material chamber has a rod receiving opening opposite to the nozzle body, a distal end of the rod extends through the rod receiving opening, a junction between the fluent material chamber and one end of the flow channel is located between the rod receiving opening and the inner space of the nozzle body, wherein the plurality of rod-shaped piezoelectric elements have different maximum-displacements, and the one of the plurality of rod-shaped piezoelectric elements that contacts the back end of the rod has the smallest maximum-displacement of the plurality of rod-shaped piezoelectric elements.

* * * * *